US005213066A

United States Patent [19]

Sausner et al.

[11] Patent Number: 5,213,066

[45] Date of Patent: May 25, 1993

[54] EVAPORATION COOLED INTERNAL COMBUSTION ENGINE

[75] Inventors: Andreas Sausner, Frankfurt am Main; Klaus Mertens, Hemsbach; Jens Sielaff, Wald-Michelbach; Karl-Heinrich Spies, Birkenau; Hans-Peter Jaekel, Frellstedt; Hans-Juergen Schäfer, Brunswick, all of Fed. Rep. of Germany

[73] Assignee: Firma Carl Freudenberg, Weinheim/Bergstr., Fed. Rep. of Germany

[21] Appl. No.: 770,166

[22] Filed: Oct. 2, 1991

[30] Foreign Application Priority Data

Oct. 5, 1990 [DE] Fed. Rep. of Germany ..... 4031475

[51] Int. Cl.[5] ..... F01P 4/02

[52] U.S. Cl. ..... 123/41.2; 123/41.5

[58] Field of Search ..... 123/41.2, 41.21, 41.5, 123/41.15

[56] References Cited

U.S. PATENT DOCUMENTS 1,676,045 7/1928 Perry ..... 123/41.5

FOREIGN PATENT DOCUMENTS 1252221 12/1960 France ..... 123/41.15

2149012 6/1985 United Kingdom ..... 123/41.5

*Primary Examiner*—Noah P. Kamen

*Attorney, Agent, or Firm*—Kenyon & Kenyon

[57] ABSTRACT

An evaporation-cooled internal combustion engine, in which a cooling system which contains a coolant and an equalization container connected with it are provided. The equalization container is connected to a steam-filled zone of the cooling system by means of a line.

7 Claims, 1 Drawing Sheet

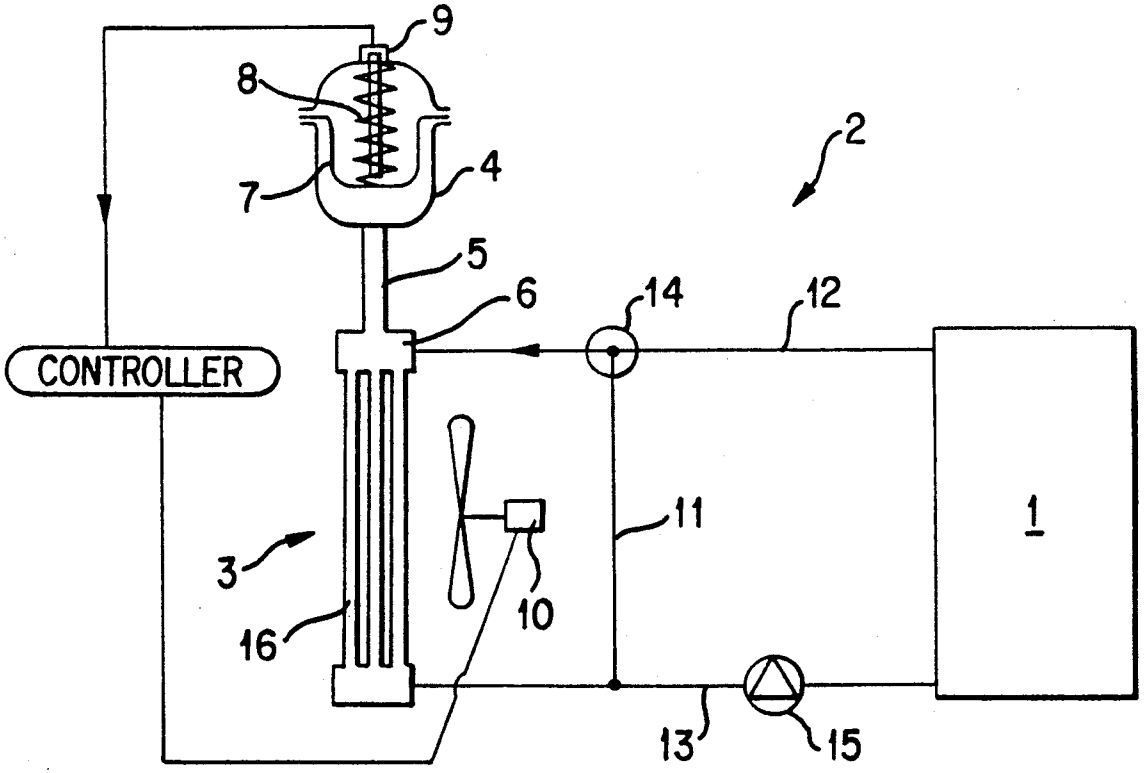
1
2
3
4
5
6
7
8
9
10
11
12
13
14
15
16
CONTROLLER

EVAPORATION COOLED INTERNAL COMBUSTION ENGINE

BACKGROUND OF THE INVENTION

The invention relates generally to an evaporation-cooled internal combustion engine, and more particularly, to improvements in the cooling system of such an engine in which the cooling system includes coolant and an equalization container connected with it. An internal combustion engine having a cooling system is disclosed in DE-OS 38 09 136. The operation of this cooling system requires a large number of sensors, making the internal combustion engine complex in structure and susceptible to break-down.

The invention is directed to the problem of further developing the cooling system of an internal combustion engine so as to provide relatively simple structure that also achieves greater operating reliability.

SUMMARY OF THE INVENTION

The invention solves this problem by providing the cooling system of an internal combustion engine with an equalization chamber connected to the steam end of a heat exchanger.

In the internal combustion engine according to the invention, an equalization container is connected to a gas-filled zone of the cooling system by means of a line. The line and the equalization container are not structured to have flow through them. Under normal operating conditions, they are not heated in any special manner. Consequently, gas (air) contained within either the line or the equalization container, under both normal operating conditions as well as when the internal combustion engine is shut off, is generally free of water droplets. The equalization container is nevertheless able to accommodate the volume which results from heating of the coolant contained in the cooling system, due to the operation of the engine.

This heating results in evaporation of coolant components in the internal combustion engine, which can be condensed in the condenser, parallel to its formation, during the same time interval, in terms of its volume. The condenser is sized in such a way that under normal operating conditions, it is almost completely filled with evaporated coolant. The cooling surfaces of the condenser conduct away the condensation heat released when the coolant liquefies again, to a correspondingly great extent.

The equalization container can be closed off towards the outside by means of a resilient wall which is impermeable both to liquid and gas, in order to preclude the escape of coolant. The wall may be in the form a component of a floating piston, for example, which can be moved back and forth in a cylindrically structured equalization container, if desired.

In one embodiment, the wall is structured to be elastically resilient, which advantageously provides for the simplified control of the cooling system. In such embodiments, the wall always has a very definite position as a function of the operating temperature of the internal combustion engine. This temperature can be detected using simple monitoring devices, which makes it possible to draw conclusions concerning the absence of leaks in the cooling system as a whole.

The wall can be supported on a secondary spring, for example on a spiral spring made of a metallic material, which is integrated into the equalization container. The deformation paths which occur under normal operating conditions are almost constant over an extremely long period of use in such embodiments, which is very advantageous with regard to monitoring of operating reliability of the internal combustion engine.

As an alternative to a secondary spring of the type mentioned above, an air cushion can also be used. The production of a correspondingly structured equalization container is very simple an thus can be achieved in a cost-effective manner.

According to another embodiment, a sensor for continuous acquisition of the internal pressure is assigned to the equalization container. The signal given off by the sensor in this embodiment permits conclusions about the instantaneous operating temperature of the internal combustion engine. The signal is used by a controller to activate an auxiliary device, for example a cooling air fan and/or a cooler blind, which helps cool the condenser to the extent required. In this connection, it has proven to be particularly practical if the sensor is assigned to the relatively mobile wall, which limits the equalization container with regard to the environment. In this way, it is protected against the effects of contact with the coolant, which simplifies its manufacture and improves the operating reliability over long periods.

BRIEF DESCRIPTION OF THE FIGURE

FIG. 1 shows an evaporation-cooled internal combustion engine in a schematic representation.

DETAILED DESCRIPTION

In the internal combustion engine 1 shown, a cooling system 2 is provided, which has a condenser 3 as well as an equalization container 4. The equalization container 4 is connected with the gas-filled zone 6 of the cooling system 2 by means of a line 5. In the present case, this zone forms the highest point of the condenser 3. All the points of the cooling system 3 and the internal combustion engine 1 which are below this zone 6 are normally completely filled with liquid coolant when the internal combustion engine is cold.

After the internal combustion engine 1 is started up, it releases heat. This results in the formation of steam in the area of the upper end, which is continuously conducted away via a line 12. The line 12 is directly connected with a return line 13, by a coolant separator 14 and a short-circuit line 11. The return line opens out into the lower end of the internal combustion engine 1 and includes a pump 15, by means of which the feed of liquid coolant components to the internal combustion engine can be increased, if necessary. The lines 11, 12 and 13 mentioned above can provide sufficient condensation of the steam volume leaving the internal combustion engine 1 under certain conditions, for example at cold ambient temperatures and/or with an extremely short period of operation. In such cases, particularly rapid heating of the internal combustion engine to operating temperature takes place, which reduces wear and makes it possible to make excess heat of the internal combustion engine available for heating the interior of a motor vehicle, even immediately after the engine is started.

Under normal operating conditions, in contrast, a larger proportion of the steam volume leaving the internal combustion engine 1 at the upper end is passed to the condenser 3 and fed into it at the upper end. Outside air can flow through the condenser 3 perpendicular to the direction of its cooling elements 16. The cooling elements 16 are cooled off as a result of this air flow, which causes condensation of the steam being passed through them from above. At the lower end of the condenser 3, only liquid coolant is therefore available, independent of the operating conditions prevailing in each case. This coolant is drawn in by the pump 15, to the extent required, and fed into the internal combustion engine 1 at the lower end.

As a function of the stress on the internal combustion engine 1 in each case, the coolant level within the condenser 3 can vary slightly. Essentially, the equalization container serves to improve the efficacy of the condenser by controlling the air mass in the cooling system as a function of pressure. For this purpose, the equalization container 4 is connected to a steam-filled zone 6 of the cooling system by means of a dummy line 5. The dummy line essentially contains only gas which has the normal ambient temperature, i.e. the temperature of air without steam, which is taken from the cooling system. Independent of the degree of stress of the internal combustion engine 1, air is therefore no longer able to impair the efficacy of the condenser.

In the equalization container 4, there is a membrane 7 which is structured to be elastically resilient and impermeable for liquids. The membrane 7 closes the interior of the cooling system off with respect to the outside. It is supported on the back by a secondary spring, which consists of metal and makes it possible to guarantee a certain internal pressure within the cooling system. The deviations in this regard are balanced out by the equalization container 4, which is connected with a steam-filled zone 6 of the cooling system by means of a line 5.

A sensor 9 is attached at the back of the equalization container 4. This sensor allows a determination of the position of the membrane 7 in each instance and forms a signal from it, which permits a direct conclusion concerning the current operating temperature of the internal combustion engine 1. The signal is therefore suited, in excellent manner, for controlling an auxiliary device 10, which allows an adjustment of the condensation effect of the condenser 3 to the requirements of the stress in each case. In the present case, such a device 10 is a cooling air fan. The device can be supplemented or replaced by a signal-activated cooler blind, if necessary.

What is claimed is:

1. An evaporation cooling system for an internal combustion engine, comprising:

a conduit for transferring coolant to an internal combustion engine and for removing coolant from an internal combustion engine;

a heat exchanger having a first end for receiving coolant from the engine by way of said conduit and a steam-filled zone located in the region of said first end, and a second end from which may be withdrawn coolant for the engine by way of said conduit, said heat exchanger serving to transfer heat from the coolant as it moves from the first end to the second end; and an equalization container having only one port, said port connected to said steam-filled zone by a line, said equalization container including a resilient displaceable wall that is supported on a secondary spring.

2. The device according to claim 1, wherein the wall is elastically resilient.

3. An evaporation cooling system for an internal combustion engine, comprising:

a conduit for transferring coolant to an internal combustion engine and for removing coolant from an internal combustion engine;

a heat exchanger having a first end for receiving coolant from the engine by way of said conduit and a steam-filled zone located in the region of said first end, and a second end from which may be withdrawn coolant for the engine by way of said conduit, said heat exchanger serving to transfer heat from the coolant as it moves from the first end to the second end; and an equalization container connected to said steam-filled zone by a line, said equalization container including a displaceable wall that is supported on an air cushion.

4. An evaporation cooling system for an internal combustion engine, comprising:

a conduit for transferring coolant to an internal combustion engine and for removing coolant from an internal combustion engine;

a heat exchanger having a first end for receiving coolant from the engine by way of said conduit and a steam-filled zone located in the region of said first end, and a second end from which may be withdrawn coolant for the engine by way of said conduit, said heat exchanger serving to transfer heat from the coolant as it moves from the first end to the second end;

an equalization container connected to said steam-filled zone by a line;

a sensor connected with the equalization chamber for generating a signal reflective of the internal pressure of the equalization container; and means for selectively enhancing the rate at which heat is transferred from said heat exchanger, said means being responsive to the signal generated by said sensor.

5. The device according to claim 4, wherein the means for selectively enhancing the heat transfer rate from the heat exchanger includes a fan.

6. An evaporation cooling system for an internal combustion engine, comprising:

a conduit for transferring coolant to an internal combustion engine and for removing coolant from an internal combustion engine;

a heat exchanger having a first end for receiving coolant from the engine by way of said conduit and a steam-filled zone located in the region of said first end, and a second end from which may be withdrawn coolant for the engine by way of said conduit, said heat exchanger serving to transfer heat from the coolant as it moves from the first end to the second end;

an equalization container including an elastic wall, said equalization chamber being connected to said steam-filled zone by a line; and a sensor connected with the equalization chamber for generating a signal reflective of the internal pressure of the equalization container having only one port, said port by measuring the displacement of the elastic wall of the equalization chamber.

7. Method for cooling an engine, comprising the steps of:

feeding coolant to an engine for absorbing heat therefrom and withdrawing the heated coolant from the engine;

circulating the coolant through an air-cooled heat exchanger;

providing an equalization container attached by a line to the high temperature end of said heat exchanger, said line and said equalization container containing air whose pressure varies with the quantity of heat generated by the engine;

sensing the pressure of the air within the equalization chamber by providing a sensor for generating a signal representative of said pressure; and using said signal to control a means for selectively influencing the rate at which heat is transferred from the heat exchanger.

* * * * *